United States Patent [19]

Woldy et al.

[11] 4,247,302

[45] Jan. 27, 1981

[54] PROCESS FOR GASIFICATION AND PRODUCTION OF BY-PRODUCT SUPERHEATED STEAM

[75] Inventors: Paul N. Woldy; Harold C. Kaufman; Michael M. Dach; James F. Beall, all of Houston, Tex.

[73] Assignee: Texaco Inc., White Plains, N.Y.

[21] Appl. No.: 57,225

[22] Filed: Jul. 13, 1979

[51] Int. Cl.[3] ..... C10J 3/46; C10K 1/02

[52] U.S. Cl. ..... 48/197 R; 48/206; 55/80; 122/7 R; 252/373

[58] Field of Search ..... 48/197 R, 200, 201, 48/202, 206, 209, 210; 252/373; 55/80; 165/158; 122/7 R

[56] References Cited

U.S. PATENT DOCUMENTS

| | | | |
|---|---|---|---|
| 2,699,384 | 1/1955 | Peery et al. | 48/206 |
| 3,963,457 | 6/1976 | Hess | 48/200 |
| 4,074,981 | 2/1978 | Slater | 48/197 R |
| 4,099,382 | 7/1978 | Paull et al. | 48/197 R |
| 4,121,912 | 10/1978 | Barber et al. | 48/197 R |

FOREIGN PATENT DOCUMENTS

| | | | |
|---|---|---|---|
| 2650512 | 5/1978 | Fed. Rep. of Germany | 48/210 |
| 673164 | 6/1952 | United Kingdom | 48/202 |

*Primary Examiner*—Peter F. Kratz
*Attorney, Agent, or Firm*—Carl G. Ries; Robert A. Kulason; Albert Brent

[57] ABSTRACT

Coal or other high ash containing carbonaceous solid fuel is reacted with a free-oxygen containing gas, with or without a temperature moderator, in a down-flow partial oxidation gas generator to produce a stream of raw synthesis gas, fuel gas, or reducing gas. A large portion of the combustion residue, i.e. molten slag and/or particulate solids that is entrained in the down-flowing generated gas stream is removed by gravity when the gas stream is passed through a diversion chamber. The main gas stream leaving the diversion chamber through the side outlet passes upward through a solids separation zone, optionally including gas-gas quench cooling, cyclones, filters, impingement separators, or combinations thereof. Next, most of the sensible heat in the gas stream is recovered by indirect heat exchange with boiler feed water and steam. Saturated and superheated steam are produced. In the main gas cooling zone, the hot gas stream with a substantially reduced solids content is passed serially through the tubes of two or more communicating shell-and-straight fire tube gas coolers. Saturated steam, which is produced in one, or more of said gas coolers, is superheated in another of said gas coolers.

18 Claims, 1 Drawing Figure

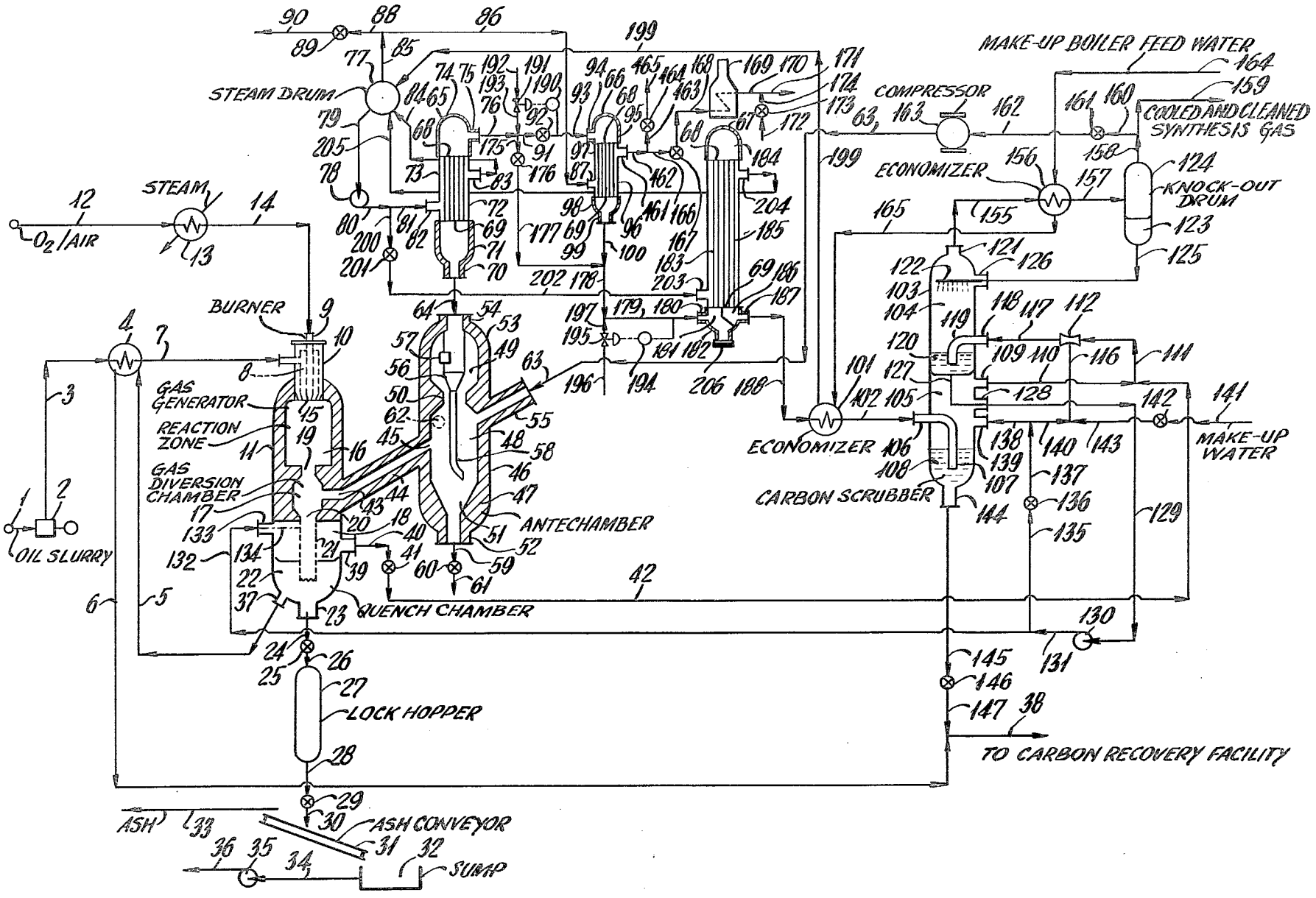
MAKE-UP BOILER FEED WATER
COOLED AND CLEANED SYNTHESIS GAS
KNOCK-OUT DRUM
MAKE-UP WATER
TO CARBON RECOVERY FACILITY
COMPRESSOR
ECONOMIZER
ECONOMIZER
CARBON SCRUBBER
STEAM DRUM
ANTECHAMBER
QUENCH CHAMBER
LOCK HOPPER
ASH CONVEYOR
SUMP
ASH
BURNER
GAS GENERATOR
REACTION ZONE
GAS DIVERSION CHAMBER
STEAM
$O_2$/AIR
OIL SLURRY

PROCESS FOR GASIFICATION AND PRODUCTION OF BY-PRODUCT SUPERHEATED STEAM

BACKGROUND OF THE INVENTION

1. Field of the Invention

This invention relates to the manufacture of cooled and cleaned gaseous mixtures comprising $H_2$ and CO, and by-product superheated steam. More particularly it pertains to a process for the manufacture of a cooled and cleaned stream of synthesis gas, fuel gas, or reducing gas, and by-product superheated steam by the partial oxidation of ash containing solid carbonaceous fuels.

2. Description of the Prior Art

The hot raw gas stream leaving a gas generator in which an ash containing solid fuel is burned will contain various amounts of molten slag and/or solid material such as soot and ash. It will often be necessary, depending on the intended use for the gas, to reduce the concentration of these entrained solid materials. By removing solids from the gas stream, one may increase the life of apparatus located downstream that is contacted by the raw gas stream. For example, the life of such equipment as gas coolers, compressors, and turbines, may be increased.

In co-assigned U.S. Pat. No. 2,871,114-Du Bois Eastman, the hot raw gas stream leaving the gas generator is directed into a slag pot and then into a quench accumulator vessel where all of the ash is intimately contacted with water. All of the sensible heat in the gas stream is thereby dissipated in the quench water at a comparatively low temperature level; and the gas stream leaving the quench tank is saturated with $H_2O$. U.S. Pat. No. 3,988,123 provides for a vertical 3-stage gasifier including a combustion stage, an intermediate cooling stage, and a heat recovery stage. In such a scheme not only is a portion of the sensible heat in the hot gases leaving the combustion stage lost in the cooling stage but small particles of solidified ash tend to plug the tubes in the boiler located under the gas generator. Other waste heat boilers have been proposed for use in recovering heat from gases, for example, the apparatus described in U.S. Pat. No. 2,967,515 in which helically coiled tubes are employed. Waste-heat boilers containing a combination of straight and helical, spiral, and surpentine coiled heat exchange tubes are also used. Boilers of such general design are high in cost. Further, the sharp bends in such coils make the tubes vulnerable to plugging, difficult to remove and replace, and expensive to clean and maintain.

SUMMARY OF THE INVENTION

This invention pertains to a continuous process for the partial oxidation of an ash containing solid carbonaceous fuel for producing a cool clean stream of synthesis gas, fuel gas, or reducing gas, and by-product superheated steam. In the process, particles of solid carbonaceous fuel are reacted with a free-oxygen containing gas, with or without a temperature moderator, in a down-flow refractory lined noncatalytic free-flow gas generator at a temperature in the range of about 1700° to 3100° F. and a pressure in the range of about 10 to 200 atmospheres to produce a raw gas stream comprising $H_2$, CO, $CO_2$, and one or more materials from the group $H_2O$, $H_2S$, COS, $CH_4$, $NH_3$, $N_2$, A, and containing molten slag and/or particulate matter. The direction of flow of the hot raw gas stream leaving the gas generator is diverted in a gas diversion chamber so that a large portion of the slag and/or particulate matter is separated from the gas stream by gravity. The separated slag and/or particulate matter passes through an outlet in the bottom of the diversion chamber into a quench chamber located below. About 0 to 20 vol. % of the hot gas stream may be passed through the bottom outlet of the gas diversion chamber as a bleedstream to prevent bridging of the opening with solids and plugging. The remainder of the gas stream is passed upward through an antechamber where solids separation and, optionally, quench cooling takes place. In the lower section of the antechamber, the gas stream may be directly impinged with a recycle portion of cooled and cleaned product gas. The gas stream is thereby partially cooled, partially solidifying any molten slag, and a portion of the entrained solids settle out. In the upper section of the antechamber, additional entrained solids are removed from the gas stream. While the upper chamber may be empty, preferably, one or more of the following gas-solids separation means may be located there: cyclone, impingement separator, filter, and combinations thereof.

The hot gas stream leaving the antechamber may be passed through additional gas gas-solids separation means located downstream from the antechamber. The cleaned gas stream is cooled by indirect heat exchange with a coolant, i.e., boiler feed water in a main cooling zone. Most of the sensible heat in the hot raw gas stream may be thereby used to produce saturated and superheated steam by indirect heat exchange with boiler feed water and steam. The main gas cooling zone comprises two or more communicating shell-and-straight fire tube gas coolers. Saturated steam, which is produced in one or more of said gas coolers, is superheated in another said gas coolers. Each gas cooler may have one or more passes on the shell and tube sides, and preferably is in an upright position with fixed tube sheets.

In a preferred embodiment, the hot gas stream is cooled by being passed serially through the straight tubes of three such interconnected vertical gas coolers. Boiler feed water and steam are the coolants in the first and third gas coolers. Saturated steam is produced in the first and third gas coolers, and is the coolant in the second gas cooler. By-product superheated steam is produced in the second gas cooler which is also preferred herein as the superheater. The saturated and superheated steam produced in the main gas cooling zone may be used elsewhere in the process or exported. The first and second gas coolers each comprises a shell-and-straight fire tube heat exchanger with fixed tube sheets and one pass on the shell and tube sides. The design of the third gas cooler is similar to that of the other two. However, the third gas cooler is provided with two passes on the tube-side and one pass on the shell-side. In operation, the hot gases flow up through the single bundle of tubes in the first gas cooler and then pass out of the first gas cooler and into the second gas cooler. The partially cooled gas stream then passes down through the single bundle of tubes in the second gas cooler where it loses more heat. The partially cooled gas stream leaves the superheater and passes into the left side of the bottom head of the third gas cooler. The gas stream then passes up through the tubes in the first tube-side pass of the third gas cooler, and then down through the tubes in the second tube-side pass.

The cooled gas stream then passes out through the right side of the bottom head of the third gas cooler. After leaving the main gas cooling zone, further cleaning and cooling of the gas stream with water may be effected in a downstream cooling and scrubbing zone. A carbon-water dispersion and a clean product gas stream is thereby produced. From about 0 to 80 mol percent of the clean product gas stream may be recycled to the antechamber for gas-gas quench cooling.

BRIEF DESCRIPTION OF THE DRAWING

The invention will be further understood by reference to the accompanying drawing in which:

FIG. 1 is a schematic drawing which shows the subject process in detail.

DESCRIPTION OF THE INVENTION

The present invention pertains to an improved continuous process for cooling and cleaning a hot raw gas stream principally comprising $H_2$, CO, $CO_2$, and one or more materials from the group $H_2O$, $H_2S$, COS, $CH_4$, $NH_3$, $N_2$, A and containing molten slag and/or entrained solid matter. Byproduct saturated and superheated steam are simultaneously produced. The hot raw gas stream is made by the partial oxidation of an ash containing solid carbonaceous fuel, such as coal. By means of the subject invention the combustion residues entrained in the raw gas stream from the gas generator may be partially solidified and reduced to acceptable levels of concentration and particle size. This gas may be used as synthesis gas, fuel gas, or reducing gas.

The thermal efficiency of the partial oxidation gasification process is increased by recovering the sensible heat from the hot raw gas stream. Thus, by-product high pressure steam for use in the process or for export may be produced by heat exchange of the hot gas stream with boiler feed water and steam in the main gas cooling zone. Energy recovery, however, is made difficult by the presence in the generator exhaust gases of droplets of molten slag and/or particulate solids. In the instant invention, the molten slag droplets are partially solidified and removed before they encounter heat exchange surfaces. By partially solidifying the slag particles before they impinge on solid surfaces, and/or by removing particulate solids entrained in the gas stream common problems with fouling of gas coolers are avoided. Solid surfaces are removed from the point of inception of slag cooling. Comparatively, simple low cost gas coolers are employed for heat exchange. By means of the subject invention, the recovery of thermal energy from the hot gases is simplified.

While the subject invention may be used to process the hot raw effluent gas stream from almost any type of gas generator, it is particularly suitable for use downstream of a partial oxidation gas generator. An example of such a gas generator is shown and described in coassigned U.S. Pat. No. 2,871,114, which is incorporated herewith by reference. A burner is located in the upper portion of the gas generator for introducing the feedstreams. A typical annulus type burner is shown in coassigned U.S. Pat. No. 2,928,460.

The free-flow unobstructed reaction zone of the gas generator is contained in a vertical cylindrical steel pressure vessel lined on the inside with a thermal refractory material. Preferably, the pressure vessel may comprise the following three communicating sections; (1) reaction zone, (2) gas diversion chamber, and (3) quench chamber. The central vertical axes of the three sections are preferably coaxial. Alternately, said three sections may be contained in two or three separate pressure vessels connected in series. In the main embodiment, the reaction zone is located in the upper portion of a pressure vessel; the gas diversion chamber is located about in the center portion of the same vessel; and, the quench chamber is located in the bottom portion of the same vessel below the gas diversion chamber. In the gas diversion chamber, a portion of the molten slag and/or particulate matter, separate out by gravity from the hot gas stream and pass through a bottom outlet into the quench chamber. The main gas stream is diverted away from the inlet to the quench chamber which is located below the gas diversion chamber and into a side exit passage. The quench chamber contains water for quench cooling the slag and/or particulate matter i.e., unconverted carbon, ash. Slag, particulate matter, and water are removed from the bottom of the quench chamber by way of an outlet in the bottom of the vessel.

In operation, the hot raw gas stream produced in the reaction zone, leaves the reaction zone by way of a centrally located outlet in the bottom of the reaction zone which is coaxial with the central longitudinal axis of the gas generator. The hot gas stream passes through said bottom outlet and expands directly into the diversion chamber which is preferably located directly below the reaction zone. The velocity of the hot gas stream is reduced and molten slag and/or particulate matter drop out of the gas stream. This solid matter and/or molten slag move by gravity through an outlet located in the bottom of the diversion chamber into the pool of water contained in the quench chamber located below. From about 0 to 20 vol. %, such as 0.5 to 15 vol. %, of the raw gas stream may be drawn through the bottom outlet in the diversion chamber as a stream of bleed gas, thereby carrying said separated portion of molten slag and/or particulate matter with it. The partially cooled bleed gas stream is removed from the quench chamber by way of a side outlet and a control valve. The hot bleed gas stream passing through the bottom outlet in the gas diversion chamber prevents solids from building up and thereby bridging and plugging the bottom outlet. Preferably, said bottom outlet in the diversion chamber is centrally located and coaxial with the vertical axis of the diversion chamber. Preferably, the quench chamber is located directly below the bottom outlet in the diversion chamber. The shape of the diversion chamber may be cylindrical, or it may be outwardly diverging or expanding conically from the entrance to an enlarged central portion followed by an inwardly converging or converging conically portion to the bottom and side outlets.

At least a portion i.e. about 80.0 to 100 vol % of the hot gas stream entering the diversion chamber is directed by the internal configuration of the diversion chamber, which may optionally include baffles, into a refractory lined side exit passage that is connected to an antechamber. The angle between this side exit passage and the longitudinal axis of the antechamber is in the range of about 30° to 135°, such as about 45° to 105°, say about 60°, measured clockwise from the central vertical axis of said antechamber starting in the third quadrant. There is substantially no drop in temperature or pressure of the gas stream as it passes through the gas diversion chamber.

The hot raw gas stream leaving the diversion chamber by way of the refractory lined passage enters directly into the inlet to the antechamber where additional entrained slag and/or particulate matter are removed, and, optionally the gas stream is partially cooled. Fouling of the boiler tubes in the main gas cooling section is thereby reduced, minimizing maintenance problems. The antechamber precedes the main gas cooling section, to be further described. While any suitable equipment may be used for the antechamber, a preferred arrangement comprises a closed cylindrical vertical pressure vessel whose inside walls are thermally insulated with high temperature resistant refractory. Within the vessel are two cylindrical vertical refractory lined chambers that are coaxial with the central vertical axis of the vessel. An intermediate coaxial choke-ring passage connects the upper outlet of the lower chamber with the lower inlet of the upper chamber. In one embodiment in which the hot raw gas stream entering the lower chamber is partially cooled by impingement with a portion of the cooled and cleaned recycle stream of product gas, the longitudinal axis of at least one pair of opposed coaxial internally insulated inlet nozzles passes through the walls of the lower chamber. The inlet nozzles are spaced 180° apart and are located on opposite sides of the chamber. The hot raw gas stream is passed through one inlet nozzle at substantially the same temperature and pressure as that in the reaction zone of the gas generator, less ordinary pressure drop in the lines. That is the temperature may be in the range of about 1700° to 3100° F., say about 2300° to 2800° F., and typically about 2500° F. The pressure in the antechamber is in the range of about 10 to 200 atmospheres, say about 25 to 85 atmospheres, and typically about 40 atmospheres. The inlet velocity is in the range of about 10 to 100 feet per second, say about 20 to 50 feet per second, and typically about 30 feet per second. The concentration of the solids in the entering hot raw gas stream is in the range of about 0.1 to 4.0 grams (gms.) per standard cubic foot (SCF), say about 0.25 to 2.0 gms per SCF. The particle size may be in the range of about 40 to 1000 micrometers, or roughly equivalent to Stairmand's Coarse dust-Filtration and Separation Vol. 7, No. 1 page 53, 1970 Uplands Press Ltd., Croydon, England. Hot raw synthesis gas containing entrained solids is passed through the inlet nozzle of the lower quench chamber and a comparatively cooler and cleaner recycle stream of quench gas produced downstream and recycled back to the antechamber is passed through the opposite inlet nozzle. The two streams impinge each other within the lower chamber and the head-on collision produces a turbulent mixture of gases. The high turbulence results in rapid mixing of the opposed gas streams and particles entrained in the gas stream drop out and are removed by way of an outlet at the bottom of the lower quench chamber.

While the previous discussion pertained to a single pair of inlet nozzles, which is the usual design, a plurality of pairs of inlet nozzles, sayd 2 to 10, of similar description, may be employed. The pairs of nozzles may be evenly spaced around the vessel. Preferably, the longitudinal axis of the inlet for the hot raw gas stream is inclined upward as shown in the drawing or downward. However, depending on the nature and concentration of entrained solids, the longitudinal axis for the inlet nozzle through which the hot raw gas passes may be horizontal or inclined downward. Thus, the longitudinal axis of each pair of inlet nozzles is in the plane of and may be at an angle in the range of about 30° to 135° with and measured clockwise, starting in the third quadrant, from the central vertical axis of the antechamber. Suitably, this angle may be in the range of 45° to 105°, say about 60°; as shown in the drawing. The actual angle is a function of such factors as temperature and velocity of the gas streams, and the composition, concentration and characteristics of the entrained matter to be removed. For example, when the raw gas stream contains liquid slag of high fluidity, the longitudinal axis of the raw gas inlet nozzle is pointed upward at a 60° angle measured clockwise from the central vertical axis of the antechamber. By this means, much of the slag would then run down the feed pipe and be collected in the quench chamber as previously described located below the diversion chamber. On the other hand, when the liquid slag is viscous, the flow of the slag may be helped by pointing the raw gas inlet nozzle downward at an angle with the vertical axis of the antechamber, say at about 135° with and measured clockwise from the central vertical axis, starting in third quadrant. The high velocity of the hot raw gas stream passing through the inlet nozzle and the force of gravity would then help to move the viscous liquid slag into the lower chamber, where it solidifies and is separated from the gas stream by gravity.

When employed, the cooled clean recycle stream of quench gas enters through the opposite inlet nozzle and is obtained from at least a portion i.e. about 20 to 80 mol %, say about 30 to 60 mol % and typically about 50 mol % of cooled and cleaned product gas produced downstream. The temperature of the recycle quench gas is in the range of about 275° to 800° F., say about 300° to 600° F., and typically about 370° F. The mass flow rate and/or the velocity of the hot raw gas stream and the cooled cleaned recycled stream of quench gas are adjusted so that the momentum of the two opposed inlet gas streams is about the same.

The ends of each pair of opposed inlet nozzles preferably do not extend significantly into the chamber. Preferably, the opposed inlet nozzles terminate in planes normal to their centerline. By this means, deviation of these streams from concentricity is minimized. The jets of gas which leave from the opposed nozzles travel about 5 to 10 feet, say about 8 feet, before they directly impinge with each other. The high turbulence that results in the lower chamber promotes rapid mixing of the gas streams. This promotes gas to particle heat transfer. Thus, through turbulent mixing of the cooled and cooling streams of gas, solidification of the outer layer of the slag particles takes place before the slag can impinge on solid surfaces. A gas mixture is produced having a temperature below the initial deformation temperature of the slag entering with the gas stream i.e., about 1200° to 1800° F., typically about 1400° F. The entrained slag is cooled and a solidified shell is formed on the slag particles which prevent them from sticking to the inside walls of the apparatus, or to any solid structural member contained therein.

In another embodiment, the amount of slag entrained in the hot raw gas stream entering the lower chamber of the antechamber is minimized or elmininated by control of the composition of the solid carbonaceous fuel and the temperature in the gasifier. In such case, the element of gas-gas impingement and quench cooling of the entering hot raw gas stream with a cooled and cleaned recycle gas stream may be advantageously minimized or completely eliminated. In such case the gas stream leaves the antechamber at substantially the same temperature as that of the entering hot raw gas stream, less ordinary thermal losses. All other aspects of the antechamber are the same as that for the mode employing gas-gas quenching.

In one embodiment, from about 1 to 50 vol. % of the recycle quench gas stream is introduced into the subject gas-gas quench cooling and solids separation vessel by way of a plurality of tangential nozzles located at the top of the lower chamber and/or the bottom of the upper chamber. By this means, a swirl is imparted to the upward flowing gases which helps to direct the upward flowing gas stream into an additional, but optional, solid separation means, such as one or more cyclones, located in the upper solid separating chamber of the antechamber. Additionally, this will provide a protective belt of cooler gas along the inside wall of the choke ring and above.

The bottom of the pressure vessel has a low point that is connected to the bottom outlet in the lower gas-gas quench chamber. For example, the shape of the bottom of the pressure vessel may be truncated cone, or spherically, or elliptically shaped. Solid matter i.e. unconverted coal, carbon particles, carbon containing particulate solids, mineral matter including slag particles, ash, and bits of refractory separate from the raw gas stream and fall to the bottom of the lower chamber where they are removed through an outlet at the bottom of the antechamber. A lock-hopper system for maintaining the pressure in the vessel is connected to the bottom outlet.

The choke ring corridor joining the lower and upper chambers is used to dampen out the turbulence of the gas stream rising up in the vessel from the lower chamber. By this means the upward flow of the gas stream is made orderly. In comparison with the turbulence in the bottom chamber, the gas stream passing up into the upper chamber is relatively calm. This promotes gravity settling of solid particles which fall down through the choke ring and into the bottom of the lower chamber. The choke ring is preferably made from a thermally resistant refractory. Its diameter is smaller than either the diameter of the upper or the lower chamber. The diameters of the upper and lower chambers depend on such factors as the velocity of the gas stream flowing therein and the size of the entrained particles. The ratio of the diameter of the upper chamber ($d_u$) to the diameter of the lower chamber ($d_l$) is in the range of about 1.0 to 1.5, such as about 1.0. The ratio of the diameter of the choke ring ($d_c$) to the diameter of the lower chamber ($d_l$) is in the range of about 0.5 to 0.9 such as about 0.6 to 0.8, say 0.75.

While the upper chamber may be empty, preferably there may be mounted within the upper chamber at least one, such as 2–12, say 2 gas-solid separation means for removing at least a portion of the solid particles remaining in the gas stream. The actual number of such additional gas-solid separation means will depend on such factors as the dimensions of the upper chamber and the actual volumetric rate of the gas stream approaching the entrance to the gas-solid separation means at the top of the upper chamber. At this point, the concentration of solids is in the range of about 0.005 to 2 grams per SCF. The particle size is in the range of about 40 to 200 micrometers. Any conventional continuous gas-solid separation means may be employed in the upper chamber that will remove over about 65 wt.% of the solid particles in the gas stream and which will withstand the operating conditions in the upper chamber. The pressure drop through the gas-solid separation means is preferably less than about 20 inlet velocity heads. Further, the solids separation means should withstand hot abrasive gas streams at a temperature up to about 3000° F., say up to 2000° F.

Typical gas-solids separation means that may be used in the upper chamber may be selected from the group: single-stage cyclone separator, impingement gas-solid separator, filter, and combinations thereof.

The gas-solids separators are preferably of the cyclone-type. A cyclone is essentially a settling chamber in which the force of gravity is replaced by centrifugal acceleration. In the dry-type cyclone separator, the stream of raw gas laden with particulate solids enters the cylindrical conical chamber tangentially at one or more entrances at the upper end. The gas path involves a double vortex with the raw gas stream spiraling downward at the outside and the clean gas stream spiraling upward on the inside to a central, or concentric gas outlet tube. The clean gas stream leaves the cyclone and then passes out of the vessel through an outlet at the top. The solid particles, by virtue of their inertia, will tend to move in the cyclone toward the separator wall from which they are led into a discharge pipe by way of a central outlet at the bottom of the cyclone. The discharge pipe or dipleg extends downward within the pressure vessel from the bottom of the cyclone to preferably below the longitudinal axes of the inlet nozzles in the bottom chamber, and below the highly turbulent area. Particulate solids that are separated in the cyclone may be thereby passed through the dipleg and discharged through a check valve into the bottom of the lower chamber below the zone of vigorous mixing. The dipleg may be removed from the path of the slag droplets by one or more of the following ways: keeping the dipleg close to the walls of the vessel, straddling the axis of the hot gas and quench gas inlet nozzles, or by putting ceramic diplegs in the refractory wall. Alternately, the diplegs may be shortened to terminate anyplace above the top of the lower chamber.

Single stage or multiple cyclone units may be employed. For example, one or more single stage cyclones may be mounted in parallel within the upper chamber. The inlets to the cyclone are located in the upper portion of the upper chamber, and face the stream of gas flowing therethrough. In such case the gas outlet tubes of each cyclone may discharge into a common internal plenum chamber that is supported within the upper chamber. The cleaned gas stream exits the plenum through the gas outlet at the top of the upper chamber. In another embodiment, at least one multiple cyclone unit is supported within the upper chamber. In such case, the partially clean gas stream that is discharged from a first internal cyclone is passed into a second internal cyclone that is supported within the upper chamber. The gas stream from each second cyclone is discharged into a common internal plenum chamber that is supported at the top of the upper chamber. From there the clean gas is discharged to an outlet at the top of the upper chamber. In still other embodiments, one and two stage cyclones are arranged external to the upper chamber, either separately or in addition to the internal cyclones. For a more detailed description of cyclone separators, and impingement gas-solids separators, reference is made to CHEMICAL ENGINEERS HANDBOOK-Perry & Chilton, 5th edition, 1973 McGraw-Hill Book Company, pages 20–80 to 20–87, which is incorporated herein by reference.

The velocity of the gas stream through the choke ring may vary in the range of about 2 to 5 ft. per sec. The velocity of the gas stream through the upper chamber basis net cross section may vary in the range of about 1 to 3 ft. per sec. The upward superficial velocity of the gas stream in the upper chamber and the diameter and height of the upper chamber, preferably may be such that the inlet to the cyclone separator (or separators) is above the choke ring by a distance at least equal to the Transport Disengaging Height (TDH), also refered to as the equilibrium disengaging height. Above the TDH, the rate of decrease in entrainment of the solid particles in the gas stream approaches zero. Particle entrainment varies with such factors as viscosity, density and velocity of the gas stream, specific gravity and size distribution of the solid particles, and height above the choke ring. The Transport Disengaging Height may vary in the range of about 10 to 25 ft. Thus, for example, if the velocity of the gas stream is about 3.5 ft./sec. through the choke ring and about 2 ft./sec. basis total cross section of the upper chamber or 2.5 ft./sec. basis net cross section of the upper chamber, then, the Transport Disengaging Height may be about 15 to 20 ft. in an upper chamber having an inside diameter of about 10 to 15 feet. The pressure drop of the gas stream passing through the antechamber is less than about 5 psi.

In one embodiment, in place of or in addition to the solids separation means located inside of the upper chamber of the antechamber, outside solids separation means may be located downstream from the antechamber and prior to the main gas cooling zone. The solids separation means located outside of the antechamber means may be selected from the group: single or multiple cyclone separators, gassolids impingement separators, filters, electrostatic precipitators, and combinations thereof.

The main gas cooling zone, is locate directly downstream from the antechamber or any solids separation means located after the antechamber. The temperature of the gas stream entering the main gas cooling zone is in the range of about 1200° to 3000° F., such as about 1200° to 1800° F., say about 1600° F. The concentration of solids in this gas stream is in the range of about 10 to 700 Mgr. per SCF. Next, most of the sensible heat in the gas stream is removed in the main gas cooling zone comprising two or more interconnected shell-and-straight fire tube gas coolers i.e. heat exchangers. Each gas cooler has one or more passes on the shell and tube sides, and preferably has fixed tube sheets. In comparison, with the gas coolers employed in the subject process, the conventional synthesis gas coolers for producing high pressure steam are of a spiral-tube, helicaltube, or serpentine-coil design. Gas coolers with such coils of tubes are difficult to clean and maintain; they are relatively expensive; and they tend to plug if the solids loading in the gas is significant. Costly down-time results when boilers with such coils require servicing. Advantageously, these problems are avoided in the subject process which employs two or more gas coolers each comprising a shell-and-a plurality of parallel straight fire tubes.

The gas coolers are preferably arranged in the subject process to provide two stages of cooling—a first or high temperature stage, and a second or low temperature stage. In the first or high temperature stage a preferred embodiment comprises one shell-and-straight fire tube heat exchanger with fixed tube sheets, and with one pass on the tube and shell sides. The raw gas is on the tube-side and boiler feed water is introduced into the shell-side. Inlet and outlet ends of the plurality of straight parallel tubes in the tube bundle contained in the presure shell are supported on each end by a tube sheet. The tube ends are in communication with respective inlet and outlet i.e. front end and rear end, stationary heads. The inlet and outlet sections and inlet tube sheet are refractory lined. Metal or ceramic ferrels may also be used in the inlet tube sheet to provide additional thermal protection for the tubes. The first heat exchanger is sized as short as possible to facilitate cleaning the tubes and to minimize the thermal expansion stress imposed on the fixed tube sheets. The tube sheets themselves are designed to flex slightly to eliminate excessive thermal stress. The tube O.D. is in the range of 1.5 to 2.0 times the tube O.D. of the second stage cooler. This is done to minimize the possibility of plugging the exchanger. The gas velocity is set high enough to keep the fouling problems within an acceptable range. For further details of tube-side and shell-side construction of fixed-tube-sheet heat exchangers, see pages 11-5 to 11-6, FIG. 11-2(b), and pages 11-10 to 11-18 of Chemical Engineers' Handbook-Perry and Chilton-Fifth Edition, McGraw-Hill Book Co., New York.

The second or low temperature stage of the gas cooler may comprise one or more shell-and-straight fire tube heat exchangers with fixed tube sheets, and with one or more passes on the shell and tube sides. While the design of the second stage gas cooler(s) are similar in most respects to the design of the first stage gas cooler, smaller tubes may be used in a second stage gas cooler due to fewer plugging problems at lower temperatures. By this means, the surface area available for a given shell diameter may be increased. For example, the tube diameters in the first stage gas cooler may be 3 inch O.D. while those in a second stage gas cooler may be 2 inch O.D. In a preferred embodiment, two gas coolers are in the second stage. One of the gas coolers superheats saturated steam that is produced in the other gas coolers. In another embodiment, the superheater is located in the first stage.

The direction of the longitudinal axes of the shell-and-straight fire tube heat exchangers in the main gas cooling zone may be horizontal, vertical, or a combination of both directions. However, preferably as shown in the drawing, the longitudinal axes of all of the shell-and-straight tube heat exchangers are vertical. An upright position permits separating of entrained particulate solids from the gas stream by gravity, and easy removal of particulate matter from an outlet in the lower end of the gas cooler. Further, the inlet to the first stage gas cooler is preferably located directly above the antechamber, or any additional entrained solids removal means following the antechamber.

For producing superheated steam in the main gas cooling zone, the preferred combination of gas coolers comprises three interconnected shell-and-straight vertical fire tube heat exchangers with one or two tube-side passes, one shell-side pass, and with fixed tube sheets as shown in the drawing. The construction of these gas coolers will be described later in greater detail. In operation of the preferred embodiment, the hot gas stream at a temperature in the range of about 1200° to 3000° F., say about 1200° to 1800° F., say about 1600° F. and at a pressure in the range of about 10 to 200 atmospheres is passed in indirect heat exchange with boiler feed water up through the plurality of parallel straight tubes on the tube-side of the first upright gas cooler having one pass on the tube-side and shell-side. The partially cooled gas stream leaves the first gas cooler at a temperature in the range of about 1100° F., to 2000° F., such as about 1100° to 1600° F., say about 1200° F. The coolant i.e. boiler feed water (BFW) from a steam drum is introduced into the first gas cooler on the shell-side at a temperature in the range of about 50° to 600° F., say about 490° to 600° F., say about 570° F. and leaves as saturated steam at a temperature in the range of about 430° to 600° F., say about 490° to 600° F., say 570° F. The saturated steam is stored in the steam drum.

At least a portion i.e. 50 to 100 vol. %, say about 80 to 100 vol. %, say 90 vol. %. of the gas stream leaving the first gas cooler is introduced into the second upright gas cooler as the hot stream. Preferably, the bulk of the hot gas stream from the first cooler is introduced into the straight tubes of the second gas cooler. The portion of the gas which by-passes the second cooler is set by the desired steam temperature leaving the second gas cooler. The hot gas stream is passed down through the plurality of parallel straight tubes of the one pass on the tube-side and shell-side second gas cooler in indirect heat exchange with saturated steam and leaves at a temperature in the range of about 850° to 1750° F., say about 850° to 1350° F., say about 950° F. At least a portion, i.e. about 80 to 100 vol. %, say about 90 vol. % of the saturated steam produced by the process and stored in the steam drum is introduced into the second gas cooler on the shell-side as the coolant. Superheated steam is removed from the second gas cooler with about 100° to 470° F., say about 100° to 410° F., say about 280° F. of superheat. This by-product superheated steam may be used elsewhere in the subject process as a heating medium, or as the working fluid in a turbine for producing mechanical and/or electrical energy. Excess superheated steam may be exported.

The partially cooled gas stream leaving the second gas cooler is mixed with the remainder of the partially cooled gas stream from the first gas cooler that by-passes the second gas cooler. This gas stream at a temperature in the range of about 800° to 1200° F., say about 1000° F. is passed through the plurality of parallel straight tubes of the two pass on the tube-side one pass on the shell-side upright third gas cooler in indirect heat exchange with boiler feed water. The gas stream passes up through the tubes in the first tube-side pass and then down through the tubes in the second tube-side pass. The partially cooled gas stream leaves the third gas cooler at a temperature in the range of about 450° to 700° F., say about 510° to 700° F., say about 590° F. The pressure drop through the main gas cooling zone is about 1 to 10 psig. The coolant i.e. boiler feed water from the steam drum is introduced into the third gas cooler on the shell-side at a temperature in the range of about 50° to 600° F., and leaves as saturated steam at a temperature in the range of about 430° to 600° F., say about 490° to 600° F., say 570° F. The saturated steam is stored in the steam drum. In the third gas cooler, by employing two passes on the tube-side, the length of the tubes is effectively increased for a given shell size. Savings in construction are thereby achieved. Multiple passes on the tube-side are used to reduce thermal stresses on the fixed tube sheets due to expansion. Also, multiple tube passes will reduce plot area or elevations depending on the orientation of the exchanger.

Ordinarily, superheated steam is made by heating saturated steam in a conventional externally fired heater. In one variation of the subject process, superheated steam leaving the second gas cooler, as previously described is passed through an externally fired heater where it receives additional heat. By means of this combination of steam heaters, superheated steam may be produced at a higher temperature levels i.e. having from about 300° to 570° F., say about 300° to 510° F., say 430° F. of superheat. Further, by this means the duty of the fired heater is minimized.

Optionally, as a temperature control on the superheated steam water may be injected into the superheated steam leaving the fired heater in order to lower the degree of superheat, while the fuel rate to the fired heater is adjusted.

The second and third gas coolers in the low temperature stage are designed to withstand a maximum inlet gas temperature. If for example, the tubes of the first gas cooler in the high temperature stage are fouled so that the temperature of the gas stream exiting from the first gas cooler goes up, than an optional emergency steam injection circuit has been provided to protect the second and third gas coolers from being damaged. Thus, when the inlet gas temperature exceeds a safe maximum temperature, a temperature transmitter in the gas inlet line to either or both gas coolers signals a temperature controller to open a valve in the auxiliary high pressure steam line. The control valve opens and steam is injected into the hot gas stream, thereby lowering its temperature.

In the subject process, the term "fire tube" means that the hot gas always passes through the bank of parallel straight tubes of the gas cooler. The coolant passes on the shell-side. The internal flow of the coolant within the gas cooler is controlled by such elements as: one or more inlet and exit nozzles and their location; and the number, locations, and design of transverse baffles, partitions, and weirs. Besides directing the shell-side coolant through a prescribed path, baffles are commonly used to support the straight tubes within the tube bundle.

Small diameter tubes (1 to 4 inch O.D.) may be used in the construction of the subject gas coolers. The tube diameter is chosen basis economic analysis of its effect on heat transfer, pressure drop, fouling and plugging tendencies. Long tubes afford potential savings in construction at higher pressures as the investment per unit area of heat transfer service is less for longer heat exchangers. The gas and coolant flow velocities within the heat exchanger are limited so as to avoid destructive mechanical damage by vibration or erosion, to maintain an allowable pressure drop, and to control the buildup of deposits. For example, the velocity of the hot gas through the straight tubes may be in the range of about 40 to 55 ft./sec. for a 2 inch O.D. tube depending on the temperature and pressure at any given point in the exchanger. Larger diameter tubes are used when heavy fouling is expected, and to facilitate the mechanical cleaning of the inside of the tubes. Tube-to-tube sheet attachment may be accomplished by the combination of tube end welding and rolled expansion. The tubes may be arranged on a triangular, square, or rotated-square pitch. Center-to-center spacings, tube pitch, baffle type and spacing are chosen to provide good coolant circulation avoiding hot spots on the inlet tube sheet. The heat exchanger's shell size is directly related to the number of tubes and to the tube pitch. Generally, the shell of the heat exchanger used in the subject process is constructed from high grade carbon-steel. When high pressure steam is being generated or superheated, alloy steels may be employed to reduce the required shell thickness and to lower the equipment cost.

The inlet and outlet sections of the gas coolers will normally be made of alloy steels due to the temperature and hydrogen partial pressure in the raw gas. Tube materials will generally be alloy steel by similar reasoning; however, the last pass(es) of the second stage gas cooler may be carbon steel in some cases. Flow patterns between the shell and tube-side fluids include countercurrent flow, cocurrent flow and combinations thereof.

Relevant factors affecting the size of the heat exchanger, and therefore the cost, include: pressure drop, gas composition, gas and coolant flow rates, log-mean-temperature difference, and fouling factors. An optimum heat-exchanger design is the function of many of the previously discussed interacting parameters.

The following advantages are achieved by passing the hot solids containing gas stream through the straight tubes of the subject gas cooler vs. conventional coiled tube synthesis gas coolers: (1) Heat Transfer-higher heat-transfer rates are obtained due to less fouling, (2) Fouling-velocities of the hot gases through the tubes tend to reduce fouling; straight tubes allow mechanical cleaning, (3) Pressure drop-lower pressure drop due to fewer bends and reduced possibility for plugging, and (4) Cost-lower fabrication cost due to a less complex design.

The stream of gas leaving the main cooling zone may be used as synthesis gas, reducing gas, or fuel gas. Alternately, the sensible heat remaining in the gas stream may be extracted in one or more economizers i.e. heat exchangers by preheating boiler feed water. Additional entrained particulate matter may be then removed from the gas stream by scrubbing the gas stream with water in a carbon scrubber. By this means the concentration of entrained solids may be further reduced to less than 2 Mgs per normal cubic meter. The clean gas stream leaving the carbon scrubber saturated with water may be then dewatered. Thus, the gas stream is cooled below the dew point by indirect heat exchange with boiler feed water or clean fuel gas. Condensed water is separated from the gas stream in a knockout drum. The condensate, optionally in admixture with makeup water, is returned to the carbon scrubber for use as the final stage scrubbing agent. The clean gas stream leaving from the top of the knockout drum is at a temperature in the range of about 200° to 600° F., such as about 275° to 400° F., say about 340° F. A portion of this clean gas stream in the range of about 0 to 80 vol. %, such as about 30 to 60 vol. %, say about 50 vol. % may be compressed to a pressure greater than that in the antechamber. The compressed gas stream may be recycled to the antechamber where it is introduced into the lower quench chamber as said recycle gas. The remainder of the cooled clean gas stream is removed from the top of the knockout drum as the product gas.

When a bleed gas stream is employed in the gas diversion chamber, it is also cooled and cleaned in the gas scrubbing zone along with the main gas stream. The bleed gas stream, which is split from the main gas stream in the gas diversion chamber, is passed through the bottom outlet of the gas diversion chamber, and then through a communicating dip tube which discharges under water. By this means the bleed gas stream and separated molten slag and/or particulate solids are quenched in a pool of water contained in the bottom of the quench chamber. The quench water may be at a temperature in the range of about 50° to 600° F. Optionally, the hot quench water on the way to a carbon recovery facility may be used to preheat one or more of the feed streams to the gas generator by indirect heat exchange. The bleed gas stream, after being quenched, is at a temperature in the range of about 200° to 600° F.

A wide range of ash containing combustible carbonaceous solid fuels may be used in the subject process. The term solid carbonaceous fuel as used herein to describe various suitable feed stocks is intended to include (1) pumpable slurries of solid carbonaceous fuels; (2) gas-solid suspensions, such as finely ground solid carbonaceous fuels dispersed in either a temperature moderating gas, a gaseous hydrocarbon, or a free-oxygen containing gas; and (3) gas-liquid-solid dispersions, such as atomized liquid hydrocarbon fuel or water and solid carbonaceous fuel dispersed in a temperature-moderating gas, or a free-oxygen containing gas. The solid carbonaceous fuel may be subjected to partial oxidation either alone or in the presence of a thermally liquefiable or vaporizable hydrocarbon or carbonaceous materials and/or water. Alternately, the solid carbonaceous fuel free from the surface moisture may be introduced into the gas generator entrained in a gaseous medium from the group steam, $CO_2$, $N_2$, synthesis gas, and a free-oxygen containing gas. The term solid carbonaceous fuels includes coal, such as anthracite, bituminous, subbituminous, coke, from coal and lignite; oil shale; tar sands; petroleum coke; asphalt; pitch; particulate carbon (soot); concentrated sewer sludge; and mixtures thereof. The solid carbonaeous fuel may be ground to a particle size in the range of ASTM E11-70 Sieve Designation Standard (SDS) 12.5 mm (Alternative ½ in.) to 75 mm (Alternative No. 200). Pumpable slurries of solid carbonaceous fuels may have a solids content in the range of about 25–65 weight percent (wt. %), such as 45–60 wt. %, depending on the characteristics of the fuel and the slurring medium. The slurrying medium may be water, liquid hydrocarbon, or both.

The term liquid hydrocarbon, as used herein, is intended to include various materials, such as liquified petroleum gas, petroleum distillates and residues, gasoline, naphtha, kerosene, crude petroleum, asphalt, gas oil, residual oil, tar-sand and shale oil, oil derived from coal, aromatic hydrocarbons (such as benzene, toluene, and xylene fractions), coal tar, cycle gas oil from fluid-catalytic-cracking operation, furfural extract of coker gas oil, and mixtures thereof. Also included within the definition of liquid hydrocarbons are oxygenated hydrocarbonaceous organic materials including carbohydrates, cellulosic materials, aldehydes, organic acids, alcohols, ketones, oxygenated fuel oil, waste liquids and by-products from chemical processes containing oxygenated hydrocarbonaceous organic materials, and mixtures thereof.

The use of a temperature moderator to moderate the temperature in the reaction zone of the gas generator is optional and depends in general on the carbon to hydrogen ratio of the feed stock and the oxygen content of the oxidant stream. Suitable temperature moderators include $H_2O$, $CO_2$-rich gas, liquid $CO_2$, a portion of the cooled clean exhaust gas from a gas turbine employed downstream in the process with or without admixture with air, by-product nitrogen from the air separation unit used to produce substantially pure oxygen, and mixtures of the aforesaid temperature moderatorss. A temperature moderator may not be required with feed slurries of water and solid carbonaceous fuel. However, steam may be the temperature with slurries of liquid hydrocarbon fuels and solid carbonaceous fuel. Generally, a temperature moderator is used with liquid hydrocarbon fuels and with substantially pure oxygen. The temperature moderator may be introduced into the gas generator in admixture with either the solid carbonaceous fuel feel, the free-oxyen containing stream, or both. Alternatively, the temperature moderator may be introduced into the reaction zone of the gas generator by way of a separate conduit in the fuel burner. When supplemental $H_2O$ is introduced into the gas generator either as a temperature moderator, a slurrying medium, or both, the weight ratio of supplemental water to the solid carbonaceous fuel plus liquid hydrocarbon fuel if any, is preferably in the range of about 0.2 to 0.50.

The term free-oxygen containing gas, as used herein is intended to include air, oxygen-enriched air, i.e., greater than 21 mol % oxygen, and substantially pure oxygen, i.e., greater than 95 mol % oxygen, (the remainder comprising $N_2$ and rare gases). Free-oxygen containing gas may be introduced into the burner at a temperature in the range of about ambient to 1200° F. The atomic ratio of free-oxygen in the oxidant to carbon in the feed stock (O/C, atom/atom) is preferably in the range of about 0.7 to 1.5, such as about 0.85 to 1.2.

The relative proportions of solid carbonaceous fuel, liquid hydrocarbon fuel if any, water or other temperature moderator, and oxygen in the feed streams to the gas generator are carefully regulated to convert a substantial portion of the carbon, e.g. at least 80 wt% to carbon oxides e.g. CO and $CO_2$ and to maintain an autogenous reaction zone temperature in the range of about 1700° to 3100° F. For example, in one embodiment employing a coal-water slurry feed, a slagging-mode gasifier may be operated at a temperature in the range of about 2300° to 2800° F. For the same fuel, a fly-ash mode coal gasifier may be operated at a lower temperature in the range of about 1700° to 2100° F. The pressure in the reaction zone is in the range of about 10 to 200 atmospheres. The time in the reaction zone in seconds is in the range of about 0.5 to 50, such as about 1.0 to 10.

The effluent gas stream leaving the partial oxidation gas generator has the following composition in mol %: $H_2$ 8.0 to 60.0, CO 8.0 to 70.0, $CO_2$ 1.0 to 50.0, $H_2O$ 2.0 to 50.0, $CH_4$ 0 to 30.0, $H_2S$ 0.0 to 2.0, COS 0.0 to 1.0, $N_2$ 0.0 to 85.0, and A 0.0 to 2.0. Entrained in the effluent gas stream is about 0.5 to 20 wt% of particulate carbon (basis weight of carbon in the feed to the gas generator). Molten slag resulting from the fusion of the ash content of the coal, and/or fly-ash, bits of refractory from the walls of the gas generator, and other bits of solids may also be entrained in the gas stream leaving the generator.

By means of the subject process the following advantages are achieved: (1) About 90–99.9 wt.% of the entrained molten slag and/or particulate matter in the hot raw gas stream leaving the partial oxidation gas generator may be removed. (2) Substantially all of the sensible heat in the hot raw gas stream leaving the partial oxidation gas generator is utilized thereby increasing the thermal efficiency of the process. (3) By-product saturated and superheated steam is produced at a high temperature level. The steam may be used elsewhere in the process i.e., for heating purposes, for producing power, or in the gas generator. Alternately, a portion of the by-product saturated and superheated steam may be exported. (4) Molten slag and/or particulate matter from the solid carbonaceous fuel may be readily removed upstream from the gas cooler. Fouling of heat exchange surfaces is thereby prevented. (5) Two or more comparatively low cost shell-and-straight fire-tube gas coolers are employed. The design of such gas coolers allows thermal stresses to be equally distributed over the tube sheets, simplifies tube cleaning and maintenance operations, and minimizes plot area and elevation.

DESCRIPTION OF THE DRAWING

A more complete understanding of the invention may be had by reference to the accompanying schematic drawing which shows the previously described process in detail. Although the drawing illustrates a preferred embodiment of the process of this invention, it is not intended to limit the continuous process illustrated to the particular apparatus or materials described.

With reference to the drawing, in line 1 a slurry comprising ¼ inch diameter bituminous coal in water having a solids content of 40 wt% is pumped by means of pump 2 through line 3 into heat exchanger 4. The temperature of the coal slurry is increased in heat exchanger 4 from room temperature to 200° F. by indirect heat exchange with quench water. The quench water enters heat exchanger 4 by way of line 5 and leaves by way of line 6 after giving up heat to the coal slurry. The heated coal slurry is then passed through line 7 and into the annulus passage 8 of burner 9. Burner 9 is mounted in upper inlet 10 of synthesis gas generator 11. Simultaneously, a stream of free-oxygen containing gas, such as substantially pure oxygen from line 12, is heated by indirect heat exchange with steam in heat exchanger 13, and passed into gas generator 11 by way of line 14 and the central conduit 15 of burner 9.

Synthesis gas generator 11 is a free-flow steel pressure vessel comprising the following principle sections; reaction zone 16, gas diversion chamber 17, and quench chamber 18. Reaction zone 16 and gas diversion chamber 17 are lined on the inside with a thermally resistant refractory material. Alternately, these three sections may comprise two or more distinct and interconnected communicating units.

The vertical central axis of upper inlet 10 is aligned with the central vertical axis of the gas generator 11. The reactant streams impinge on each other and partial oxidation takes place in reaction zone 16. A hot raw gas stream containing entrained molten slag, and/or particulate matter including unconverted carbon and bits or refractory passes through the axially aligned opening 19 located in the bottom of reaction zone 16 and enters into an enlarged gas diversion chamber 17. The velocity and direction of the hot gas stream are suddenly changed in diversion chamber 17. A small portion i.e. bleedstream of the raw gas is, optionally, drawn through the bottom throat 20 of the gas diversion chamber 17, dip leg 21, and into water 22 contained in the bottom of quench chamber 18. By this means outlet 20 is kept open, a portion of the molten slag and/or particulate matter is quench cooled, and the slag may be solidified. Periodicaly, solid particles and ash are removed from quench chamber 18 by way of lower axially aligned outlet 23, line 24, valve 25, line 26, lock hopper 27, line 28, valve 29, and line 30. Ash and other solids are separated from the quench water by means of ash conveyor 31 and sump 32. The ash is removed through line 33 for use as fill. Quench water is removed from the sump by way of line 34. pump 35 and line 36 and may be recycled to the quench chamber. A portion of the quency water is removed from the bottom of the quench chamber through outlet 37 and is introduced by way of line 5 into heat exchanger 4, as previously described. The cooled quench water containing carbon in line 6 is introduced into a conventional carbon removal facility (not shown) for reclaiming the quench water by way of line 38. The recovered carbon is then added to the coal slurry as a portion of the feed to the gas generator. Any bleed gas is removed from quench chamber 18 through side outlet 39, line 40, valve 41, and line 42.

The hot raw gas stream leaving diversion chamber 17 with a portion of the molten slag and/or particulate matter removed is diverted through refractory lined side exit passage 43 and is then upwardly directed through refractory lined transfer line 44, and into inlet 45 of antechamber 46. Antechamber 46 is a closed cylindrical vertical steel pressure vessel lined on the inside throughout with refractory 47 and includes coaxial lower solids separating chamber 48, coaxial upper solids separating chamber 49, and coaxial refractory choke ring 50. Choke ring 50 forms a cylindrically shaped passage of reduced diameter between lower chamber 48 and upper chamber 49. Antechamber 46 has a conical shaped bottom 51 that converges into refractory lined coaxial bottom outlet 52. Hemispherical dome 53 at the top of vessel 46 is equipped with refractory lined top outlet 54. Outlet 54 is coaxial with the vertical axis of vessel 46. A pair of refractory lined opposed coaxial inlet nozzles 45 and 55 extend through the vessel wall and are directed into lower chamber 46. The longitudinal axis of inlet nozzles 45 and 55 makes an angle of about 60° with the vertical central axis of vessel 46 and lies in the same plane. Inlet nozzle 45, for introducing a hot raw gas stream, is pointed upward. Inlet nozzle 55, for introducing a stream of clean and comparatively cooler recycle quench gas, is pointed downward. While only one pair of inlet nozzles is shown in the drawing, additional pairs may be included in the apparatus.

In the preferred embodiment, at least one cyclone 56, with its longitudinal vertical axis parallel or coaxial with the vertical axis of vessel 46, is supported within upper chamber 49. Each cyclone is resistant to heat and abrasion and has a gas inlet 57 near the upper portion of the upper chamber. When multiple cyclones are employed, they may be uniformly spaced within the chamber. The face of rectangular inlet 57 of cyclone 56 is preferably parallel to the vertical axis of vessel 46. The inlet is oriented to face the direction of the incoming gas stream. Thus, the cyclone inlet or inlets may be oriented to continue the direction of swirl.

Cyclone 56 is of conventional design including a cylindrical body, a converging conical shaped bottom portion, reverse chamber, outlet plenum which connects into upper outlet 54, dipleg 58, and a check valve near the bottom end of the dipleg. Dipleg 58 may be off-set to pass close to the walls of vessel 46 and thereby avoid intersecting the common longitudinal axis of inlets 45 and 55. By this means contact and build-up on the dipleg of uncooled slag particles are avoided. Cooled clean synthesis gas is discharged through top outlet 54. Particulate solids are discharged through bottom outlet 52 by way of line 59, valve 60, and line 60 and pass into a lock-hopper, not shown.

Optionally, from about 1 to 4 tangential quench gas inlets 62 are evenly spaced around the circumference of vessel 46. for example , near the top of the lower chamber 48 and/or the bottom of the upper chamber 49. By this means, a supplemental amount of cooled clean recycle quench gas may be introduced into vessel 46. The spiraling clockwise direction of the stream of recycled gas helps to direct all of the gas in the vessel upwardly. It also maintains a cool gas stream along the wall of vessel 46 which protects the refractory lining. The cooled clean recycled gas stream that may be introduced into inlet 55 and optionally into said tangential inlets 62 comprises at least a portion of the cooled clean gas stream from line 63.

It it is desired to further reduce the solids concentration of the size of the particulate solids in the gas stream leaving antechamber 46 by way of top outlet 54, then the gas stream in line 64 may be optionally introduced into a conventional solids separation zone (not shown) which may be located outside of antechamber 46. Cyclones, impingement separators, bag filters, electrostatic precipitators, or combinations thereof may be used for this purpose. These are located downstream from the antechamber and prior to the main gas cooling zone.

Most of the sensible heat in the gas stream leaving the antechamber is removed in the main gas cooling zone which in the preferred embodiment comprises three vertically disposed shell-and-straight fire tube heat exchangers 65, 66, and 67. These three gas coolers have fixed tube sheets i.e. upper tube sheets 68 and lower tube shees 69. While gas coolers 65 and 66 have one-pass on the tube-side and shell-side, gas cooler 67 has two-passes on the tube-side and on pass on the shell-side.

The hot gas stream from antechamber 46, or optionally from a supplemental solids removal facility (not shown) located downstream from antechamber 46, is cooled by being passed upwardly through line 64 and lower inlet nozzle 70 of gas cooler 65 into refractory lined lower stationary-head bonnet 71, past lower fixed tube sheet 69, through tube bundle 72 comprising a plurality of parallel straight vertical tubes located within shell 73, past upper fixed tube sheet 68, into upper stationary-head bonnet 74, through upper outlet 75, and line 76. The coolant in gas cooler 65 is boiler feed water and saturated steam. Boiler feed water in steam drum 77 is pumped by means of pump 78 through lines 79 to 81, and lower inlet 82 into the shellside of gas cooler 65. Saturated steam leaves the shellside of gas cooler 65 through upper outlet 83 and passes into steam drum 77 by way of line 84. At least a portion of the saturated steam leaves steam drum 77 through line 85 and is passed into gas cooler 66 as the coolant by way of line 86 and inlet 87. The remainder of the saturated steam, if any, is passed through line 88, valve 89 and line 90. Advantageously, this steam may be used in the process or exported. For example, a portion of this steam may be used as the heating fluid in heat exchanger 13.

Most of the partially cooled stream in line 76 is passed into upright gas cooler 66 as the heating medium to superheat saturated steam by indirect heat exchange. The gas enters by way of line 91, valve 92, line 93 and upper inlet 94 into upper bonnet 95. The gas is then passed on the tube-side through upper tube sheet 68, down through the bundle of straight parallel tubes 96 within shell 97, past lower tube sheet 69, through lower bonnet 98, and out through lower outlet 99 and line 100. Saturated steam in line 86 is passed through inlet 87 of gas cooler 66, and then upwardly on the shell-side. By-produce superheated steam is removed through upper outlet 461, lines 462, 463, valve 464, and line 465. The by-product superheated steam may be used within the subject process, for example, as the working fluid in an expansion turbine for the production of mechanical power or electrical energy. In another embodiment, at least a portion of the superheated steam in line 462 is passed through line 166, valve 167, and line 168 into externally fired heater 169 where the temperature of the superheated steam feed is increased. By-product superheated steam, at a higher temperature level, leaves heater 169 through lines 170 and 171. The superheat temperature of the steam may be controlled by water injection through line 172, valve 173, and line 174.

In one embodiment, the gas stream leaving gas cooler 65 is used as a trim control in order to increase the temperature of the gas stream leaving gas cooler 66 through line 100. This may be accomplished by passing a small portion of the gas stream in line 76 through line 175, valve 176, line 177, and mixing the two gas streams in line 178.

Additional saturated steam may be made in gas cooler 67 by passing the gas stream in line 178 through line 179, lower inlet 180 into the left side 181 of lower bonnet 182, up past lower fixed tube sheet 69, up through the left pass on the tube-side 183, into upper bonnet 184, down through the right pass on the tube-side 185, into the right side 186 of lower bonnet 182, and out through lower outlet 187 and line 188. The gas stream passes in indirect heat exchange with a portion of the boiler feed water in line 80 from steam drum 77. The boiler feed water is passed through line 200, valve 201, line 202 and lower inlet 203 into the one-pass shell side of gas cooler 67. Saturated steam leaves gas cooler 67 through upper outlet 204 and is passed through line 205 into steam drum 77.

Particulate solids that fall into lower bonnets 71, 98, and 182 respectively of gas coolers 65, 66 and 67 may be removed by way of bottom outlets, such as flanged outlet 206 for gas cooler 67.

An emergency steam injection system is provided to control the temperaure of the gas stream entering gas coolers 66 and 67. Thus, the temperature of the gas stream entering gas cooler 66 through line 93 is measured and a temperature transmitter signals temperature controller 190 to open valve 191 which controls the quantity of steam from lines 192 and 193 that is required to cool the gas stream from line 76.

Similarly, the temperature of the gas stream entering gas cooler 67 through line 179 is measured and a temperaure transmitter signals temperature controller 194 to open valve 195 which controls the quantity of steam from lines 196 and 197, that is required to cool the gas stream from line 178. Advantageously, the steam for operating the emergency steam injection system may be produced internally.

Additional entrained solids and sensible heat are removed from the gas stream leaving gas cooler 67 by way of outlet 187 and line 188, by passing the gas stream through economizer 101, line 102, and into carbon scrubber 103. Carbon scrubber 103 comprises a two section vertical vessel including upper chamber 104, and lower chamber 105. The gas stream in line 102 is passed through inlet 106 in lower chamber 105, and then through diptube 107 into waterbath 108 contained in the bottom of lower chamber 105. The oncewashed gas stream leaves lower chamber 105 by way of outlet 109, and is passed through lines 110 and 111 into venturi scrubber 112. There the gas stream is scrubbed with water from line 116. The scrubbed gas stream from venturi scrubber 112 is passed into upper chamber 104 by way of line 117 and inlet 118. By way of diptude 119, the gas stream is next introduced into and washed in waterbath 120. Before leaving upper chamber 104 by way of upper outlet 121 in the top of chamber 104, the gas sream may be given a final rinse by means of water spray 122 or by a wash tray (not shown). For example, condensate 123 from the bottom of knock-out drum 124 may be passed through line 125 and introduced through inlet 126 into spray 122. Water from pool 120 is passed through pipe 127, outlet 128, line 129, pump 130, lines 131 and 132, inlet 133, and pipe 134 into quench chamber 18. A portion of the water in line 131 may be recycled to lower chamber 105 of gas scrubber 103 by way of line 135, valve 136, lines 137 and 138, and inlet 139. Another portion of water in line 137 is passed through line 140 and mixed in line 116 with make-up water from line 141, valve 142, and line 143. The water in line 116 is introduced into venturi 112 as previously described. Water containing dispersed solids 108 from the bottom of chamber 105 is passed through outlet 144, line 145, valve 146, line 147, and mixed in line 38 with the water dispersion from line 6. The water dispersion in line 38 in sent to a conventional carbon recovery facility (not shown) where water is separated from the entrained solids. The recovered water is returned to the system as make-up. The make-up water may be introduced at various locations, for example through line 141 as previously described.

The cleaned gas stream leaving upper chamber 104 of carbon scrubber 103 by way of upper outlet 121 and line 155 is passed through economizer 156 where it is cooled below the dew point. The wet gas stream passes through line 157 into knockout drum 124 where separation of the condensed water from the gas stream takes place. A cooled and cleaned stream of product gas leaves the top of knockout drum 124 by way of lines 158 and 159. Optionally but preferably when gasifier 11 is operated in the slagging mode, a portion of this cooled and cleaned product gas stream is passed through line 160, valve 161, line 162, compressor 163, and recycled as the stream of quench gas to lower chamber 48 of antechamber 46 by way of line 63 and inlet passage 55, and optionally through tangential gas inlets 62.

Make-up boiler feed water (BFW) for cooling shell- and straight tube heat exchangers 65 and 67 is preheated by being passed through line 164, economizer 156 as the coolant, line 165, economizer 101 as the coolant, line 199, and into steam drum 77. From there the BFW is distributed to gas coolers 65 and 67, as previously described.

Other modifications and variations of the invention as hereinbefore set forth may be made without departing from the spirit and scope thereof, and therefore only such limitations should be imposed on the invention as are indicated in the appended claims.

We claim:

1. A process for the partial oxidation of an ash-containing solid carbonaceous fuel for producing a cooled cleaned product gas stream of synthesis gas, fuel gas or reducing gas along with by-product saturated and superheated steam comprising:

(1) reacting particles of said solid fuel with a free-oxygen containing gas and with or without a temperature moderator in a down-flow refractory lined gas generator at a temperature in the range of about 1700° to 3100° F. and a pressure in the range of about 10 to 200 atmospheres to produce a raw gas stream comprising $H_2$, CO, $CO_2$, and one or more materials selected from the group consisting of $H_2O$, $H_2S$, COS, $CH_4$, $NH_3$, $N_2$, and A, and containing molten slag and/or particulate matter;

(2) passing the gas stream from (1) down through the central outlet in the bottom of the reaction zone and into a separate thermally insulated gas diversion chamber provided with a side outlet and a bottom outlet; separating by gravity molten slag and/or particulate matter from said gas stream; passing from about 0 to 20 vol. % of said gas stream as bleed gas along with said separated material through the bottom outlet of said diversion chamber and into a pool of quench water in a quench chamber located below said diversion chamber; and passing the remainder of said gas stream through a side exit passage in said diversion chamber directly through a thermally insulated transfer line and inlet passage of a separate thermally insulated gas-gas quench cooling and solids separation zone at substantially the same temperature and pressure as produced in step (1) less ordinary pressure drop in the lines;

(3) impinging the gas stream from (2) in said gas-gas quench cooling and solids separation zone with a stream of recycle quench gas comprising cooled cleaned and compressed product gas from (7), thereby partially cooling the gas stream from (2) partially solidifying entrained molten slag, and separating from the gas stream a portion of the slag and particulate matter; and passing the partially cooled gas stream up through a separate thermally insulated upper chamber located above and communicating with said gas-gas quench cooling and solids separation zone and removing additional entrained solids from the gas stream;

(4) cooling the gas stream from (3) in a main gas cooling zone and producing by-product saturated and superheated steam by passing said gas stream in indirect heat exchange with preheated boiler feed water first upward through the tubes in a first upright high temperature shell-and-straight fire tube gas cooler having refractory lined inlet and outlet sections, one pass on the shell and tube sides and having fixed tube sheets, then passing the gas stream in indirect heat exchange with saturated steam down through the tubes in a second upright shell-and-straight fire tube gas cooler having one pass on the tube-side and shell-side and having fixed tube sheets, and then passing the gas stream in indirect heat exchange with preheated boiler feed water up through the tubes in the first tube-side pass of a third gas cooler comprising an upright low temperature shell-and-straight fire tube gas cooler having two passes on the tube-side and one pass on the shell-side and having fixed tube sheets, and then down through the tubes in the second tube-side pass of said third gas cooler; and wherein saturated steam is produced on the shell-sides of said first and third gas coolers, and at least a portion of which is superheated on the shell-side of said second gas cooler to produce by-product superheated steam while the remainder, if any, is removed as by-product saturated steam and preheating boiler feed water for use in (4) by indirect heat exchange with the gas stream leaving said third gas cooler;

(5) cooling, and scrubbing the gas stream from (4) with water in gas cooling and scrubbing zones producing a carbon-water dispersion;

(6) cooling the gas stream from (5) below the dew point and separating condensed water to produce said cooled, cleaned stream of product gas; and (7) compressing a portion of said product gas stream from (6) and introducing same into said gas-gas quench cooling and solids separation zone in (3) as said stream of recycle quench gas.

2. The process of claim 1 provided with the added step of separating additional solid matter from the gas stream leaving step (3) by introducing said gas stream into one or more gas-solids separation means located before said main gas cooling zone in step (4) and selected from the group consisting of: single or multiple cyclones, impingement separator, filter, electrostatic precipitator, and combinations thereof.

3. The process according to claim 1 further comprising the step of passing the gas stream in step (2) into said gas-gas quench cooling and solids separation zone by way of said transfer line and inlet passage whose longitudinal axis is at an angle in the range of about 30° to 135° with and measured clockwise starting in the third quadrant from the central vertical axis of said solids separation zone.

4. The process according to claim 1 wherein the upper chamber in step (3) contains one or more gas-solids separation means selected from the group consisting of cyclone, gas-solids impingement separators, filter, and combinations thereof.

5. The process of claim 1 wherein said solid carbonaceous fuel is selected from the group consisting of particulate carbon, coal, coke from coal, lignite, petroleum coke, oil shale, tar sands, asphalt, pitch, concentrated sewer sludge, and mixtures thereof.

6. The process of claim 1 wherein said free-oxygen containing gas is selected from the group consisting of air, oxygen-enriched air, i.e. greater than 21 mol % oxygen, and substantially pure oxygen, i.e., greater than 95 mol % oxygen.

7. The process of claim 1 wherein said temperature moderator is selected from the group consisting of $H_2O$, $CO_2$-rich gas, liquid $CO_2$, a portion of the cooled clean exhaust gas from a gas turbine with or without admixture with air, nitrogen, and mixtures thereof.

8. The process according to claim 1 further comprising the steps of mixing together at least a portion of said carbon-water dispersion from (5) with or without concentration and solid fuel to produce a solid fuel slurry, and gasifying said solid fuel slurry in the gas generator in step (1).

9. The process of claim 1 wherein said solid carbonaceous fuel is subjected to partial oxidation either alone or in the presence of substantially thermally liquifiable or vaporizable hydrocarbon and/or water.

10. The process according to claim 8 further comprising the step of pre-heating said solid fuel slurry feed to the gas generator with a portion of the quench water from said quench chamber in (2).

11. The process according to claim 1 wherein about 0.5 to 15 vol. % of the raw gas stream from (1) is introduced into said quench water along with said slag and/or particulate matter.

12. The process according to claim 1 where in (2) said stream of bleed gas and separated material are passed through dip tube means into said quench water.

13. The process according to claim 1 provided with the steps of producing said preheated boiler feed water for use in (4) by serially passing fresh boiler feed water in indirect heat exchange first with the gas stream from (5) and then with the gas stream leaving the third gas cooler in (4).

14. The process according to claim 1 provided with the steps of simultaneously passing separate portions of preheated boiler feed water from a steam drum through the shell-sides of said first and third gas coolers in (4) and passing the steam produced thereby into said steam drum; and introducing at least a portion of the saturated steam from said steam drum into the shell-side of said second gas cooler.

15. The process according to claim 1 wherein about 0 to 50 vol. % of the gas stream leaving the first cooler in step (4) by-passes the second gas cooler and is mixed with the gas stream leaving the second gas cooler.

16. A process for the partial oxidation of an ash-containing solid carbonaceous fuel for producing a cooled cleaned product gas stream of synthesis gas, fuel gas or reducing gas and by-product saturated and superheated steam comprising:

(1) reacting particles of said solid fuel with a free-oxygen containing gas and with or without a temperature moderator in a down-flow refractory lined gas generator at a temperature in the range of about 1700° to 3100° F. and a pressure in the range of about 10 to 200 atmospheres to produce a raw gas stream comprising $H_2$, CO, $CO_2$, and one or more materials selected from the group consisting of $H_2O$, $H_2S$, COS, $CH_4$, $NH_3$, $N_2$, and A, and containing molten slag and/or particulate matter;

(2) passing the gas stream from (1) down through the central outlet in the bottom of the reaction zone and into a separate thermally insulated diversion chamber provided with bottom and side outlets; separating by gravity molten slag and/or particulate matter from said gas stream; passing from about 0 to 20 vol. % of said gas stream as bleed gas along with said separated material through the bottom outlet of said diversion chamber and into a pool of quench water in a quench chamber located below said diversion chamber; and passing the remainder of said gas stream through a side exit passage in said diversion chamber directly through a thermally insulated transfer line and inlet passage of a separate thermally insulated vertical gas-solids separation zone comprising upper and lower communicating chambers, at substantially the same temperature and pressure as produced in step (1) less ordinary pressure drop in the lines;

(3) passing the gas stream from (2) up through said gas-solids separation zone separating from the gas stream by gravity in said lower chamber a portion of the slag and/or particulate matter; removing additional entrained solids from the gas stream in said upper chamber with or without one or more solids separation means selected from the group consisting of cyclone, impingement separator, filter and combinations thereof;

(4) cooling the gas stream from (3) in a main gas cooling zone and producing by-product saturated and superheated steam by passing said gas stream in indirect heat exchange with preheated boiler feed water first upward through the tubes in a first upright high temperature shell-and-straight fire tube gas cooler having refractory lined inlet and outlet sections, one pass on the shell and tube sides and having fixed tube sheets, then passing the gas stream in indirect heat exchange with saturated steam down through the tubes in a second upright shell-and-straight fire tube gas cooler having one pass on the tube-side and shell-side and having fixed tube sheets, and then passing the gas stream in indirect heat exchange with preheated boiler feed water up through the tubes in the first tube-side pass of a third gas cooler comprising an upright low temperature shell-and-straight fire tube gas cooler having two passes on the tube-side and one pass on the shell-side and having fixed tube sheets, and then down through the tubes in the second tube-side pass of said third gas cooler; and wherein saturated steam is produced on the shell-sides of said first and third gas coolers, and at least a portion of which is superheated on the shell-side of said second gas cooler to produce by-product superheated steam while the remainder, if any, is removed as by-product saturated steam; and preheating boiler feed water for use in (4) by indirect heat exchange with the gas stream leaving said third gas cooler;

(5) cooling, and scrubbing the gas stream from (4) with water in gas cooling and scrubbing zones producing a carbon-water dispersion; and (6) cooling the gas stream from (5) below the dew point and separating condensed water to produce said cooled, cleaned stream of product gas.

17. The process of claim 16 provided with the additional step of passing at least a portion of the superheated steam produced in step (4) through an externally fired heater where it is heated to a higher temperature.

18. The process of claim 16 provided with the additional step of controlling the temperature of the gas stream entering said second and third gas coolers by injecting steam into the gas stream.

* * * * *

UNITED STATES PATENT AND TRADEMARK OFFICE

CERTIFICATE OF CORRECTION

PATENT NO. : 4,247,302

DATED : January 27, 1981

INVENTOR(S) : Paul N. Woldy et al.

It is certified that error appears in the above—identified patent and that said Letters Patent is hereby corrected as shown below:

The title page showing the illustrative Figure should appear as per attached sheet.

The Figure of drawing should appear as per attached sheet.

Signed and Sealed this

*Fifth* Day of *April 1983*

[SEAL]

*Attest:*

GERALD J. MOSSINGHOFF

*Attesting Officer*

*Commissioner of Patents and Trademarks*

United States Patent [19]

Woldy et al.

[11] 4,247,302

[45] Jan. 27, 1981

[54] PROCESS FOR GASIFICATION AND PRODUCTION OF BY-PRODUCT SUPERHEATED STEAM

[75] Inventors: Paul N. Woldy; Harold C. Kaufman; Michael M. Dach; James F. Beall, all of Houston, Tex.

[73] Assignee: Texaco Inc., White Plains, N.Y.

[21] Appl. No.: 57,225

[22] Filed: Jul. 13, 1979

[51] Int. Cl.[3] ..... C10J 3/46; C10K 1/02

[52] U.S. Cl. ..... 48/197 R; 48/206; 55/80; 122/7 R; 252/373

[58] Field of Search ..... 48/197 R, 200, 201, 48/202, 206, 209, 210; 252/373; 55/80; 165/158; 122/7 R

[56] References Cited

U.S. PATENT DOCUMENTS

| | | | |
|---|---|---|---|
| 2,699,384 | 1/1955 | Peery et al. | 48/206 |
| 3,963,457 | 6/1976 | Hess | 48/200 |
| 4,074,981 | 2/1978 | Slater | 48/197 R |
| 4,099,382 | 7/1978 | Paull et al. | 48/197 R |
| 4,121,912 | 10/1978 | Barber et al. | 48/197 R |

FOREIGN PATENT DOCUMENTS

| | | | |
|---|---|---|---|
| 2650512 | 5/1978 | Fed. Rep. of Germany | 48/210 |
| 673164 | 6/1952 | United Kingdom | 48/202 |

*Primary Examiner*—Peter F. Kratz
*Attorney, Agent, or Firm*—Carl G. Ries; Robert A. Kulason; Albert Brent

[57] ABSTRACT

Coal or other high ash containing carbonaceous solid fuel is reacted with a free-oxygen containing gas, with or without a temperature moderator, in a down-flow partial oxidation gas generator to produce a stream of raw synthesis gas, fuel gas, or reducing gas. A large portion of the combustion residue, i.e. molten slag and/or particulate solids that is entrained in the down-flowing generated gas stream is removed by gravity when the gas stream is passed through a diversion chamber. The main gas stream leaving the diversion chamber through the side outlet passes upward through a solids separation zone, optionally including gas-gas quench cooling, cyclones, filters, impingement separators, or combinations thereof. Next, most of the sensible heat in the gas stream is recovered by indirect heat exchange with boiler feed water and steam. Saturated and superheated steam are produced. In the main gas cooling zone, the hot gas stream with a substantially reduced solids content is passed serially through the tubes of two or more communicating shell-and-straight fire tube gas coolers. Saturated steam, which is produced in one, or more of said gas coolers, is superheated in another of said gas coolers.

18 Claims, 1 Drawing Figure

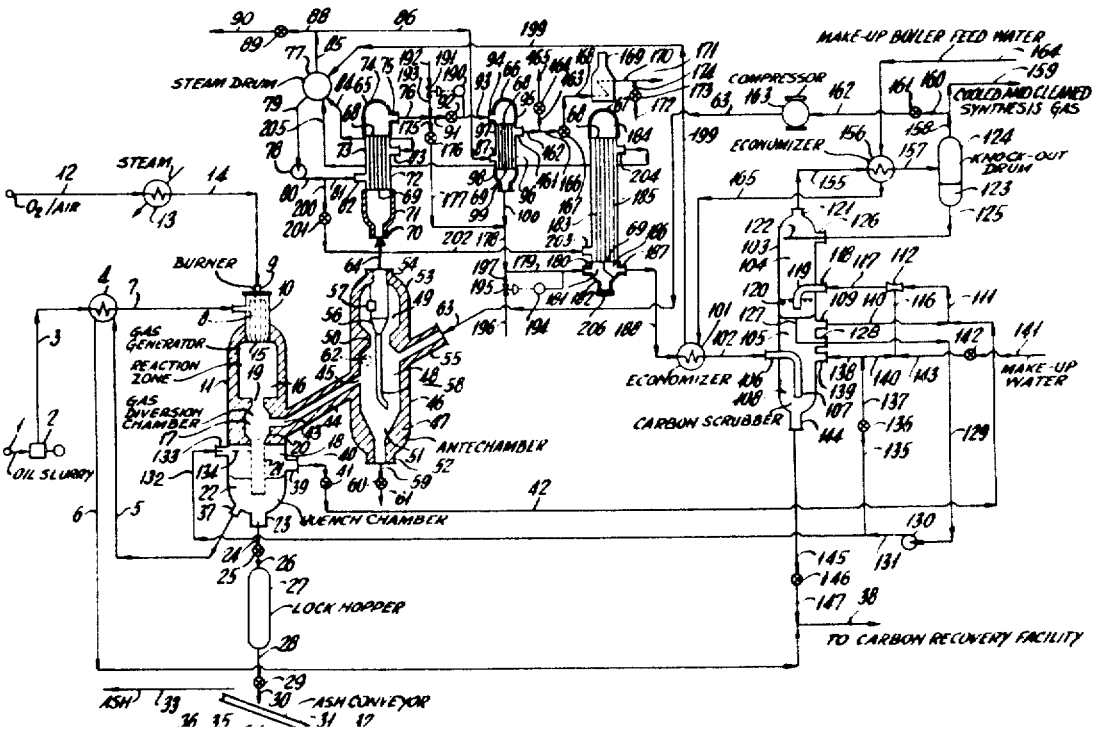

UNITED STATES PATENT AND TRADEMARK OFFICE

CERTIFICATE OF CORRECTION

PATENT NO. : 4,247,302 Page 3 of 3

DATED : January 27, 1981

INVENTOR(S) : Paul N. Woldy et al.

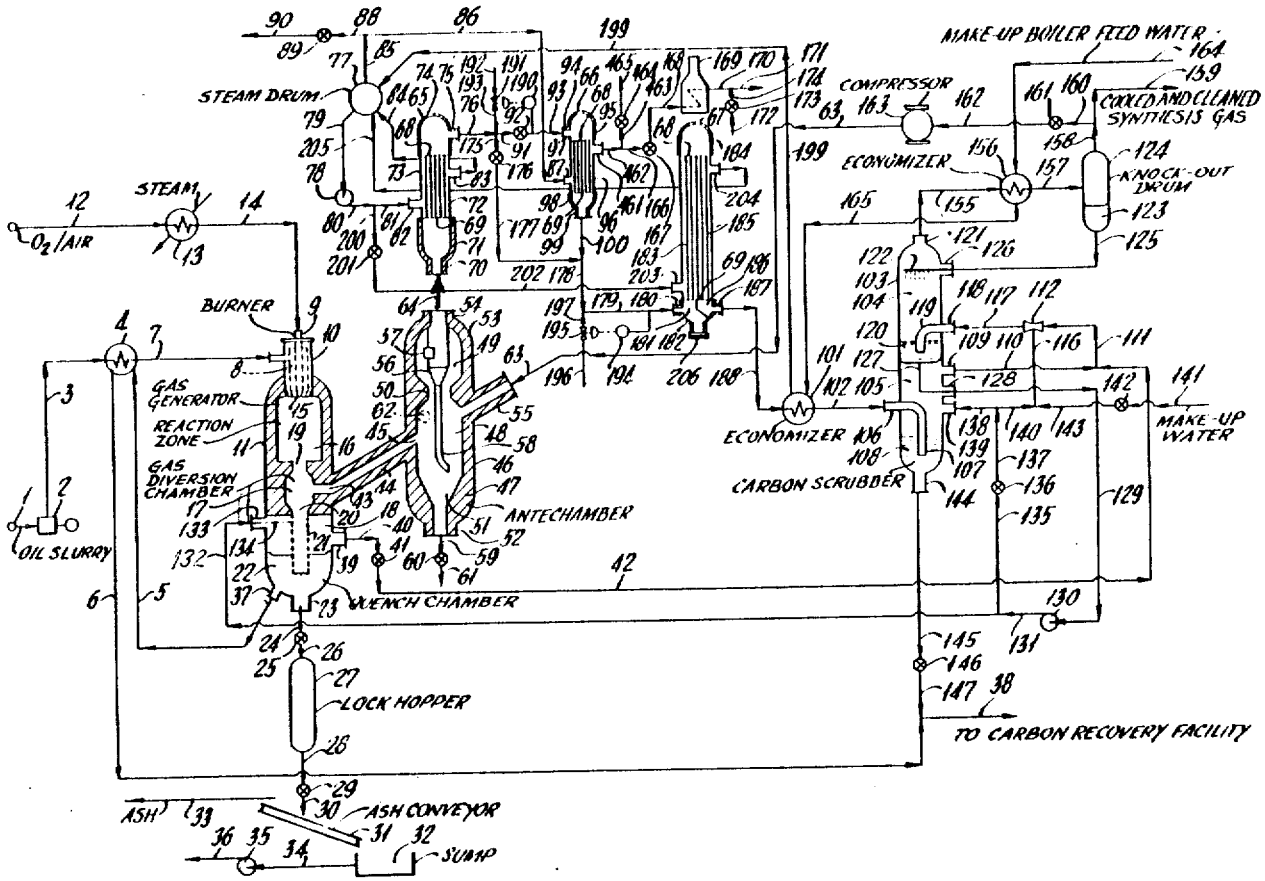

It is certified that error appears in the above-identified patent and that said Letters Patent is hereby corrected as shown below: